US005510819A

United States Patent [19]

Fujimoto et al.

[11] Patent Number: 5,510,819

[45] Date of Patent: Apr. 23, 1996

[54] INK JET PRINTING HEAD AND ELECTRONIC MACHINE INCORPORATING THE SAME

[75] Inventors: Hisayoshi Fujimoto; Akihiro Shimokata, both of Kyoto, Japan

[73] Assignee: Rohm Co., Ltd., Kyoto, Japan

[21] Appl. No.: 18,816

[22] Filed: Feb. 18, 1993

[30] Foreign Application Priority Data

Feb. 24, 1992 [JP] Japan ..... 4-036237

[51] Int. Cl.[6] ..... B41J 2/045

[52] U.S. Cl. ..... 347/70

[58] Field of Search ..... 346/140 R; 347/68, 347/70, 71, 40; B41J 2/045

[56] References Cited

U.S. PATENT DOCUMENTS 4,521,788 6/1985 Kimura et al. ..... 346/140 R
4,825,227 4/1989 Fischbeck et al. ..... 347/69

FOREIGN PATENT DOCUMENTS 57-182452 11/1982 Japan ..... 347/71
58-108163 6/1983 Japan ..... B41J 2/045

OTHER PUBLICATIONS

Tsao, C. S., "Drop–on–Demand Ink Jet Nozzle Array with Two Nozzles/Piezoelectric Crystal", IBM TDB vol. 23. No. 10 Mar. 1981, p. 4438.

*Primary Examiner*—Benjamin R. Fuller
*Assistant Examiner*—Alrick Bobb
*Attorney, Agent, or Firm*—Wolf, Greenfield & Sacks

[57] ABSTRACT

An ink jet printing head which is composed of a smaller number of parts than those in a conventional one, which leads to a reduction in the number of assembly steps, enhanced productivity and a reduction in the cost. A piezoelectric element is provided on a diaphragm at the portion corresponding to each pair of adjacent pressure chambers. A piezoelectric element includes an electrode which extends along each pressure chamber. An electronic machine incorporating this ink jet printing head is also provided.

20 Claims, 10 Drawing Sheets

INK JET PRINTING HEAD AND ELECTRONIC MACHINE INCORPORATING THE SAME

BACKGROUND OF THE INVENTION

1. Field of the Invention

The present invention relates to an ink jet printing head and an electronic machine incorporating an ink jet printing head such as, for example, a printer, a word processor, a facsimile machine or a plotter.

2. Description of the Related Art

Conventional ink jet printers are divided broadly into continuance type printers and on-demand type printers. The on-demand type printers, in which ink is injected only when it is necessary, are advantageous in that a simple apparatus suffices, although the responsiveness of the head is low. The on-demand type printers are further divided into electrostatic attraction type printers, in which ink is attracted from the nozzle by electrostatic force, and pressure pulse type printers, in which ink is forced out of the nozzle. The pressure pulse type printers are classified into piezoelectric pressure pulse type printers and bubble pressure pulse type printers. In the piezoelectric pressure pulse type printers, ink is pressurized by a piezoelectric (electrostriction) element. In one-chamber piezoelectric pressure pulse type printers, ink is supplied through a pressure chamber, while two-chamber piezoelectric pressure pulse type printers have a pressure chamber and an ink supply chamber. The one-chamber piezoelectric pressure pulse type printers are further divided into Kyser system printers which have a flat pressure chamber and Soltan system printers which have a cylindrical pressure chamber.

Ink jet printing heads of a Kyser system are mounted into an electronic machine such as a printer or a word processor. As shown in FIG. 1 (partially plan view) and FIG. 2 (partially sectional view), a Kyser system printing head is generally composed of: a multiplicity of individual ink passages 51, each including a supply passage 52, a pressure chamber 53 and an end portion 54 which constitutes a nozzle, provided on a substrate 50 in an array; a diaphragm 60 (omitted in FIG. 1, see FIG. 2) attached to the substrate 50 in such a manner as to cover all the individual ink passages 51; and piezoelectric elements 70 attached to the diaphragm 60 at the positions corresponding to the respective pressure chambers 53 of the individual ink passages 51. In order to apply an electric field to the piezoelectric elements 70, lower electrodes 71 and upper electrodes 72 are provided on the under surfaces and the upper surfaces of the respective piezoelectric elements 70, as shown in FIG. 2, for example.

In such a printing head, an electric field is applied to the piêzoelectric element 70 by applying a voltage to the lower electrode 71 and the upper electrode 72 so as to displace the piezoelectric element 70, whereby the corresponding portion of the diaphragm 60 is moved, thereby forcing ink out of the end portion 54 of the corresponding individual ink passage 51.

In this type of printing head utilizing piezoelectric elements, which are represented by a Kyser system printing head, a piezoelectric element is pasted to the corresponding portion of each individual ink passage 51 on the diaphragm 60, as is obvious from FIGS. 1 and 2. As a result, with the increase in the number of individual ink passages 51, the number of manufacturing steps including the production of piezoelectric elements and the process of pasting the piezoelectric elements to the diaphragm increases, which leads to poor productivity and rise in cost. Especially, when the number of individual ink passages 51 is increased and the width thereof and intervals therebetween are reduced in order to increase the printing density, the size of each piezoelectric element is reduced so much that it is difficult to handle each piezoelectric element.

SUMMARY OF THE INVENTION

Accordingly, it is an object of the present invention to eliminate the above-described problems in the related art and to provide an ink jet printing head which is capable of enhancing the productivity and reducing the cost and to provide an apparatus incorporating such an ink jet printing head.

To achieve this aim, an ink jet printing head according to the present invention comprises: a substrate; a multiplicity of individual ink passages formed in an array on the substrate in such a manner that each extends from one end of the substrate to the other end thereof; a diaphragm attached to the substrate in such a manner as to cover all the individual ink passages; and a diaphragm displacing means provided on the diaphragm at the portion corresponding to each couple of adjacent individual ink passages.

When the substrate has a plurality of nozzles and a plurality of pressure chambers arranged in a circle in such a manner as to surround the nozzles, a diaphragm displacing means is provided on the diaphragm at the portion corresponding to each couple of adjacent individual ink passages.

In a conventional printing head, a piezoelectric element is provided on the diaphragm at the portion corresponding to each individual ink passage. In contrast, in the printing head of the present invention, a diaphragm displacing means is provided on the diaphragm at the portion corresponding to each couple of adjacent individual ink passages. Therefore, in the printing head of the present invention, the number of necessary piezoelectric elements is reduced to half in comparison with the conventional printing head which has the same number of individual ink passages of the same size. As a result, the number of manufacturing steps including the production of piezoelectric elements and the process of pasting the piezoelectric elements to the diaphragm is reduced, which leads to high productivity and reduction in the cost. In addition, since the size of each piezoelectric element is almost doubled, it is easy to handle each piezoelectric element.

In the printing head of the present invention, each piezoelectric element is approximately the same size as two individual ink passages. If a printing head is imagined which has one piezoelectric element covering all the individual ink passages, electrodes extending along the individual ink passages and an electrode pattern for substantially dividing the piezoelectric element into the portions which correspond to the individual ink passages, and the stress produced by the piezoelectric element is compared between the printing head of the present invention and the hypothetical printing head, the stress is much smaller in the printing head of the present invention. The crosstalk of the displacement of the piezoelectric element with respect to the voltage applied to each electrode in each diaphragm displacing means can stand comparison with that of the piezoelectric element which is provided in each individual ink passage as in the conventional printing head and produces no problem in practical use.

The above and other objects, features and advantages of the present invention will become clear from the following description of the preferred embodiments thereof, taken in conjunction with the accompanying drawings.

DESCRIPTION OF THE PREFERRED EMBODIMENTS

The ink jet printing head and an electronic machine provided therewith according to the present invention will now be explained with reference to the embodiments.

Figure 1:
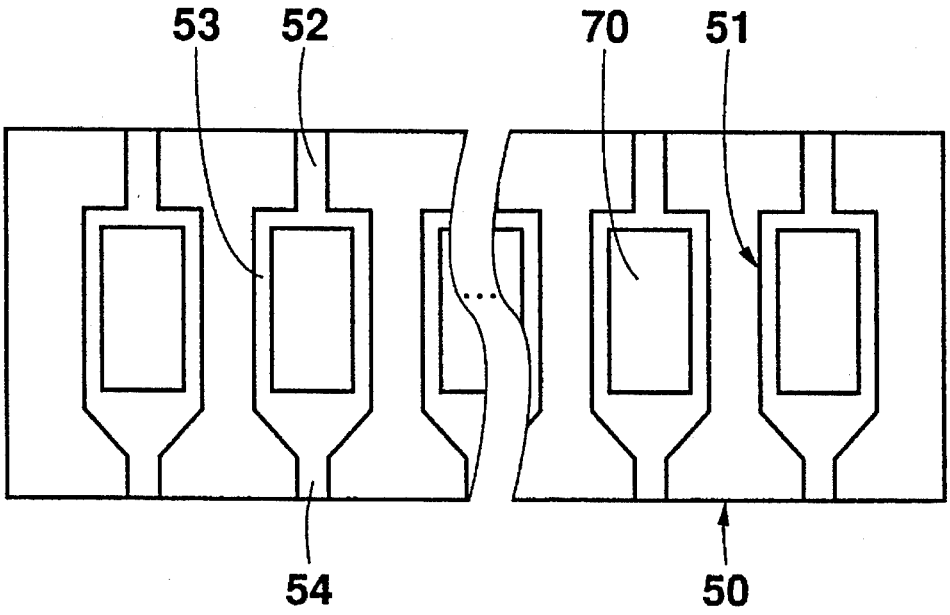
Fig. 1 PRIOR ART
FIG. 1 is a partially plan view of a conventional printing head in a Kyser system.
Figure 2:
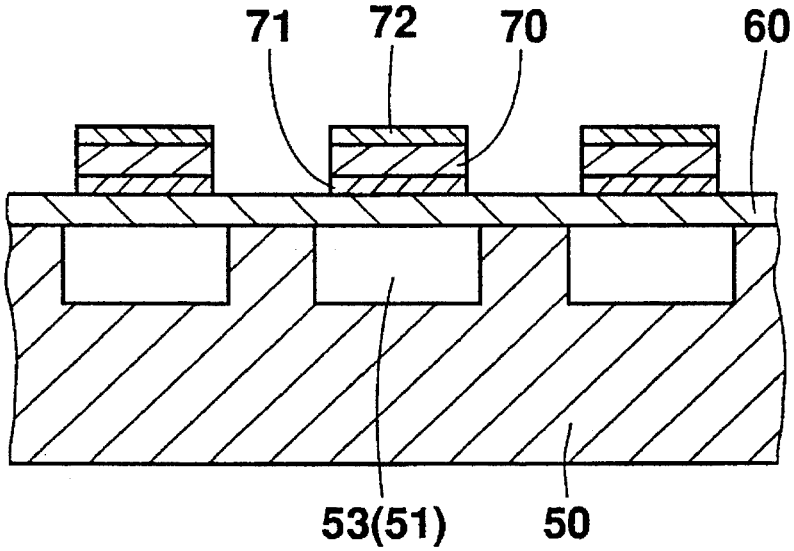
Fig. 2 PRIOR ART
FIG. 2 is an enlarged sectional view of the main part of the printing head shown in FIG. 1.
Figure 3:
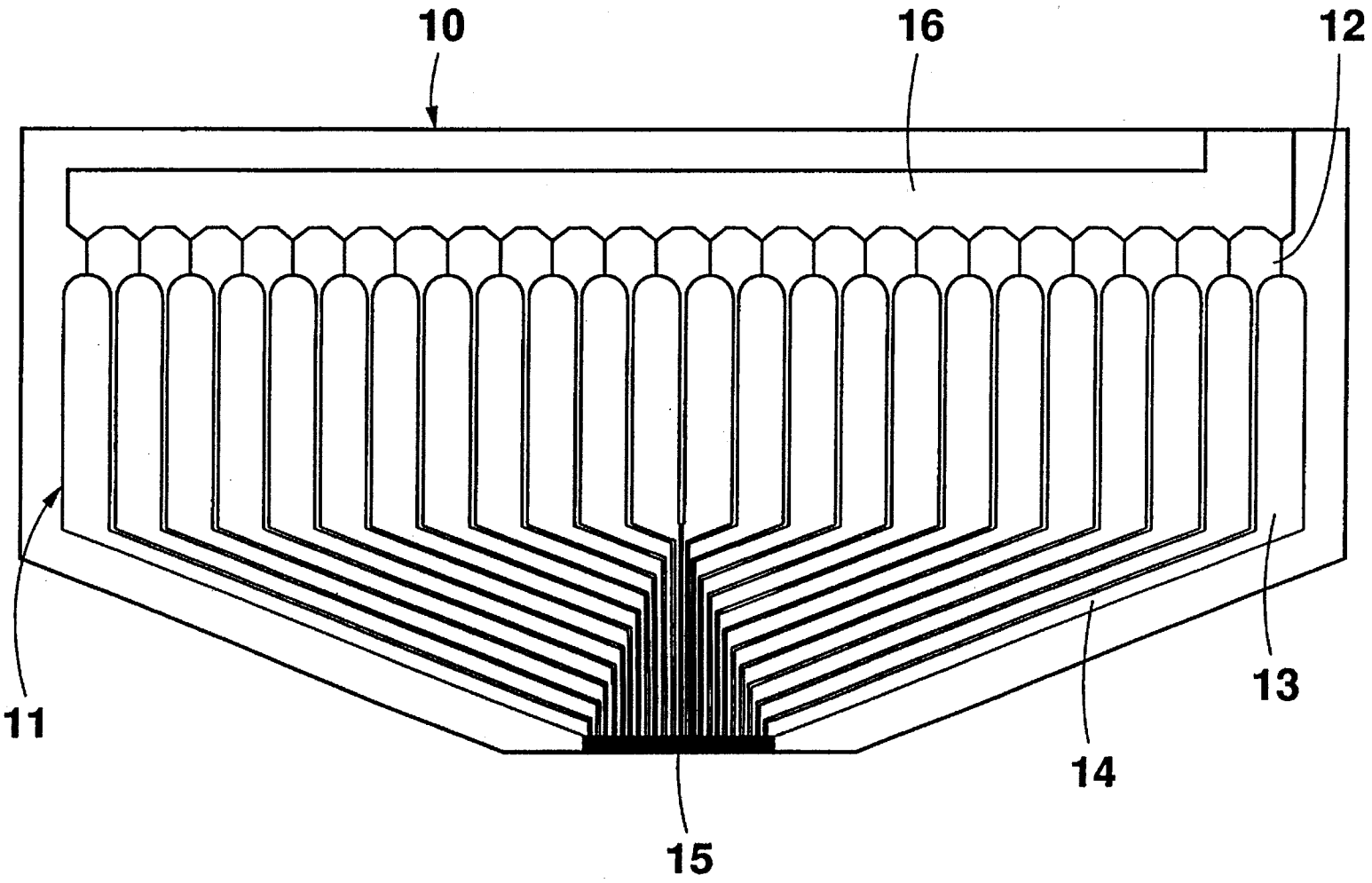
FIG. 3 is a plan view of the substrate of an embodiment of a printing head according to the present invention.

FIG. 3 is a plan view of the substrate of an embodiment of a printing head according to the present invention. In this embodiment, a plurality of (24, in this embodiment) individual ink passages 11 each of which extends from one end (rear end) of a substrate 10 to the other end (forward end) thereof are formed on the substrate 10 in an array in accordance with the ink passage pattern shown in FIG. 3. The individual ink passage 11 is composed of a narrow portion 12, a pressure chamber 13 having a large width, a leading portion 14 which extends obliquely from the pressure chamber 13, and a nozzle 15 which opens to the end surface of the substrate 10. As is obvious from FIG. 3, the leading portions 14 which connect the pressure chambers 13 and the nozzles 15 are concentrated into the center of the forward end of the substrate 10, thereby increasing the density of the nozzles 15. Each narrow portion 12 communicates with an ink supply passage 16 provided at the rear end of the substrate 10. In this way, ink passes through the ink supply passage 16 and is injected from the nozzle 15 through the individual ink passage 11.

Figure 6:
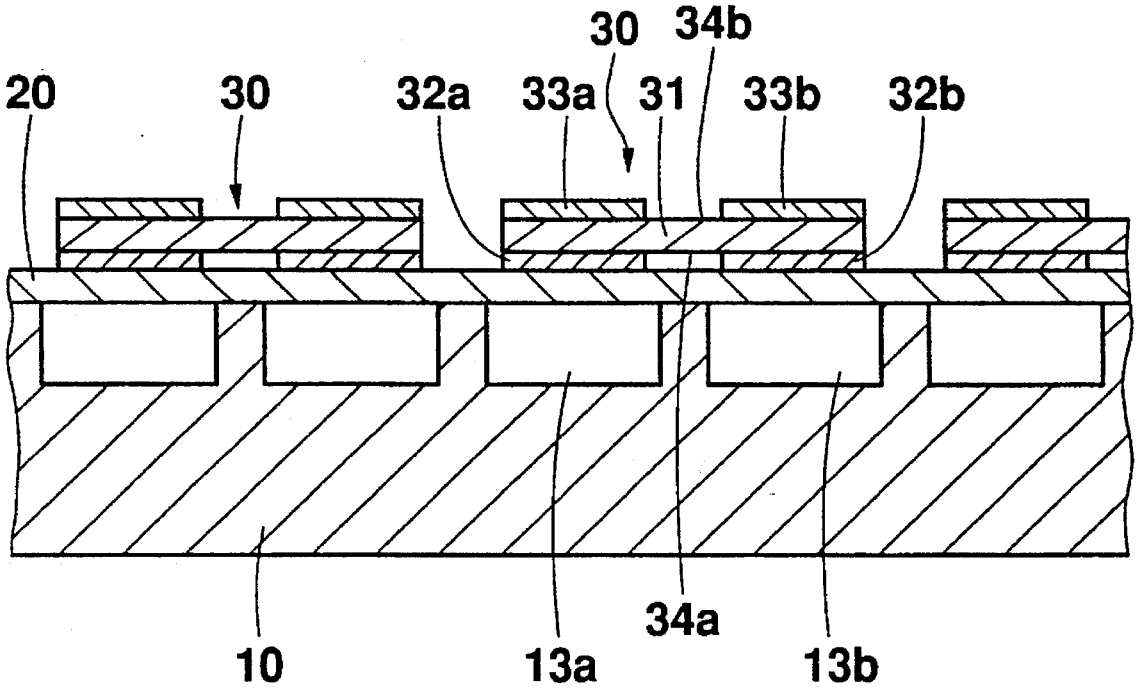
FIG. 6 is an enlarged sectional view of the main part of the printing head shown in FIG. 4.

As is shown in FIG. 6, a diaphragm 20 which covers all the individual ink passages 11 is attached to the substrate 10 on the side on which the individual ink passages 11 are provided, and the individual ink passages 11 are sealed by the diaphragm 20.

Figure 4:
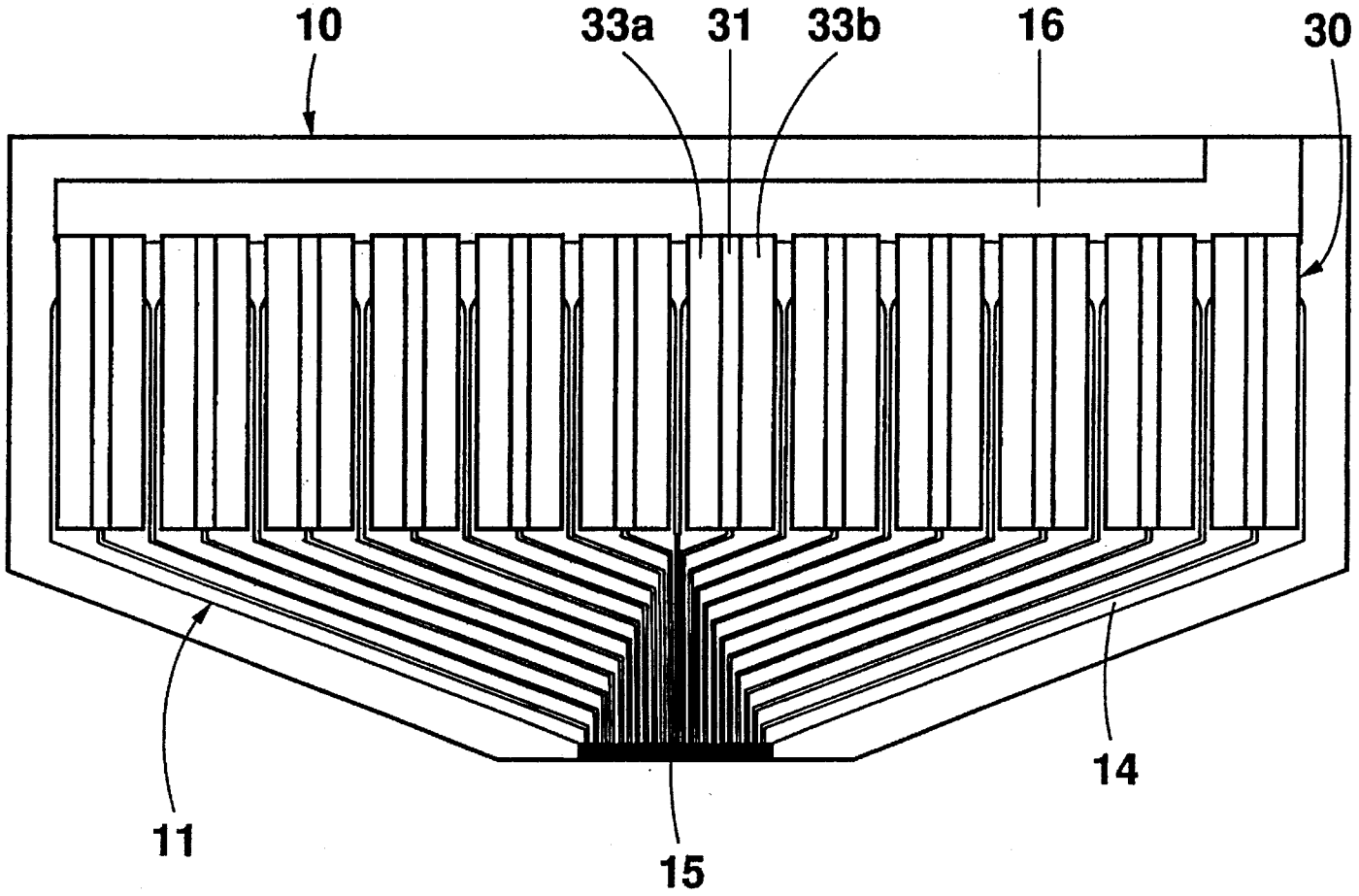
FIG. 4 is a plan view of a printing head produced by providing a diaphragm displacing means on the substrate shown in FIG. 3.
Figure 5:
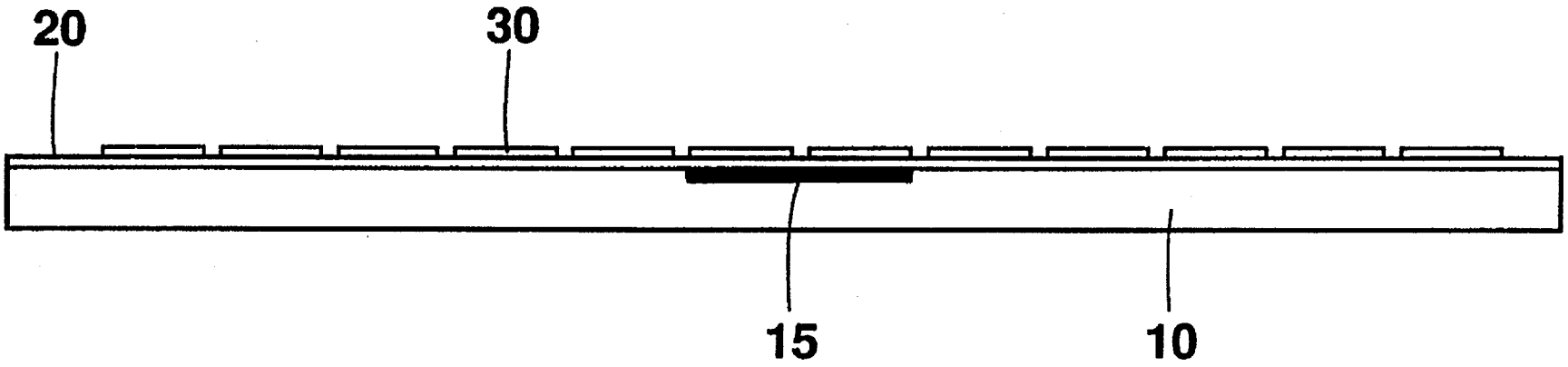
FIG. 5 is an elevational view of the printing head shown in FIG. 4.

A diaphragm displacing means 30 which has approximately the same size as two adjacent pressure chambers 13*a*, 13*b* is pasted to the corresponding portion of the diaphragm 20 on each couple of adjacent individual ink passages. As shown in FIG. 4, the diaphragm displacing means 30 extends along the two pressure chambers 13*a*, 13*b*, and has a rectangular shape having a slightly narrower width than these pressure chambers 13*a*, 13*b*.

Each diaphragm displacing means 30 is composed of a piezoelectric element 31 which is large enough to overlap the two adjacent pressure chambers 13*a*, 13*b*, lower electrodes 32*a*, 32*b* which are formed on the under surface of the piezoelectric element 31 and which are large enough to overlap the pressure chambers 13*a* and 13*b*, respectively, and upper electrodes 33*a*, 33*b* which are formed on the upper surface of the piezoelectric element 31 and which have the same size and shape as the lower electrodes 32*a*, 32*b*. Each of the lower electrodes 32 and the upper electrodes 33 has a rectangular shape having a slightly narrower width than the pressure chamber 13*a* (13*b*). Both the lower electrodes 32*a*, 32*b* and the upper electrodes 33*a*, 33*b* are arranged in parallel with each other with a predetermined interval therebetween. Each of the predetermined intervals between the lower electrodes 32*a*, 32*b* and the upper electrodes 33*a*, 33*b* constitute non-electrode portions 34*a* and 34*b*, respectively, on the under surface and the upper surface of the piezoelectric element 31. The non-electrode portions 34*a* and 34*b* are situated above the partition wall between the pressure chambers 13*a* and 13*b*. The lower electrodes and the upper electrodes are led to the end surface side of the substrate 10 in a predetermined wiring pattern (not shown).

The operation of the printing head having the above-described structure will now be described. It is now assumed that a voltage of a predetermined polarity is applied to the lower electrode 32*a* and the upper electrode 33*a* on the left-hand side of the diaphragm displacing means 30 in FIG. 6, which is an enlarged sectional view of the main part of the printing head. The polarity of the voltage applied depends upon the state of polarization of the piezoelectric element 31. When the voltage of an appropriate polarity is applied to the electrodes 32*a*, 33*a*, the corresponding portion of the piezoelectric element 31 is displaced. This displacement warps the corresponding portion of the diaphragm 20, which changes the volume of the pressure chamber 13*a*, whereby the ink is injected. It is here assumed that the corresponding portion of the piezoelectric element 31 is displaced downward. When a voltage is applied to the lower and upper electrodes 32*a*, 33*a*, the corresponding portion of the piezoelectric element 31 which is sandwiched between the electrodes 32*a*, 33*a* receives an electric field and displaces toward the diaphragm 20, thereby pressing down the corresponding portion of the diaphragm 20. The corresponding portion of the diaphragm 20 which receives the pressing force is bent and deformed toward the pressure chamber 13*a* of the individual ink passage 11. As a result, the ink storing capacity of the pressure chamber 13*a* is reduced and some of the ink in the pressure chamber 13*a* is forced out of the nozzle 15.

While the ink is being injected, the corresponding portion of the piezoelectric element 31 which is held between the lower electrode 32*b* and the upper electrode 33*b* on the right-hand side is not influenced by the displacement of the left-hand portion of the piezoelectric element 31, because the lower electrodes 32*a*, 32*b* and the upper electrodes 33*a*, 33*b* are separated from each other with the non-electrode portions 34*a*, 34*b*, respectively, therebetween. The crosstalk due to the displacement is therefore very small. In this manner, the left-hand portion and the right-hand portion of the piezoelectric element 31 in each diaphragm displacing means 30 moves independently of the displacement of the other portion. In other words, the left-hand portion and the right-hand portion of the piezoelectric element 31 are substantially separated from each other.

When the voltage is cut off after the ink is injected, the corresponding portion of the piezoelectric element 31 is restored to its original state, and the pressure chamber 13*a* is filled with ink in preparation for the next injection. Alternatively, if the polarity of the voltage is reversed, the corresponding portion of the piezoelectric element 31 is displaced upward, and the corresponding portion of the diaphragm 20 is pulled upward, whereby the ink storing capacity of the pressure chamber 13*a* is increased and the pressure chamber 13*a* is filled with ink. In this state, when the corresponding portions of the piezoelectric element 31 and the diaphragm 20 are moved, ink is injected again.

Figure 7:
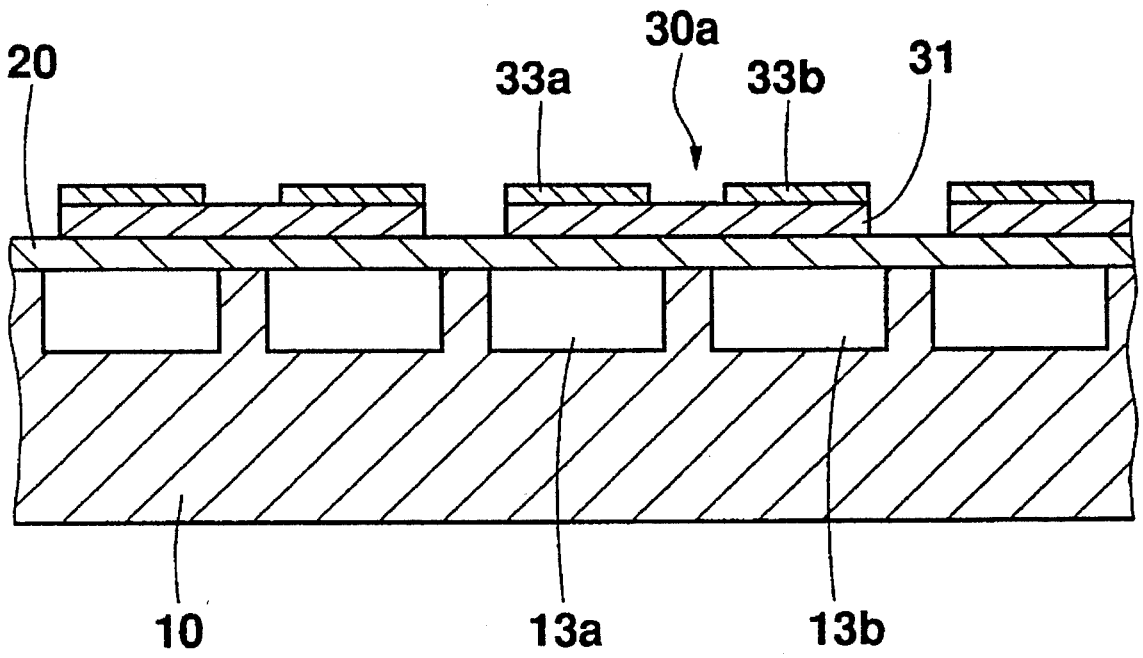
FIG. 7 is an enlarged sectional view of the main part of another embodiment of a printing head according to the present invention.
Figure 8:
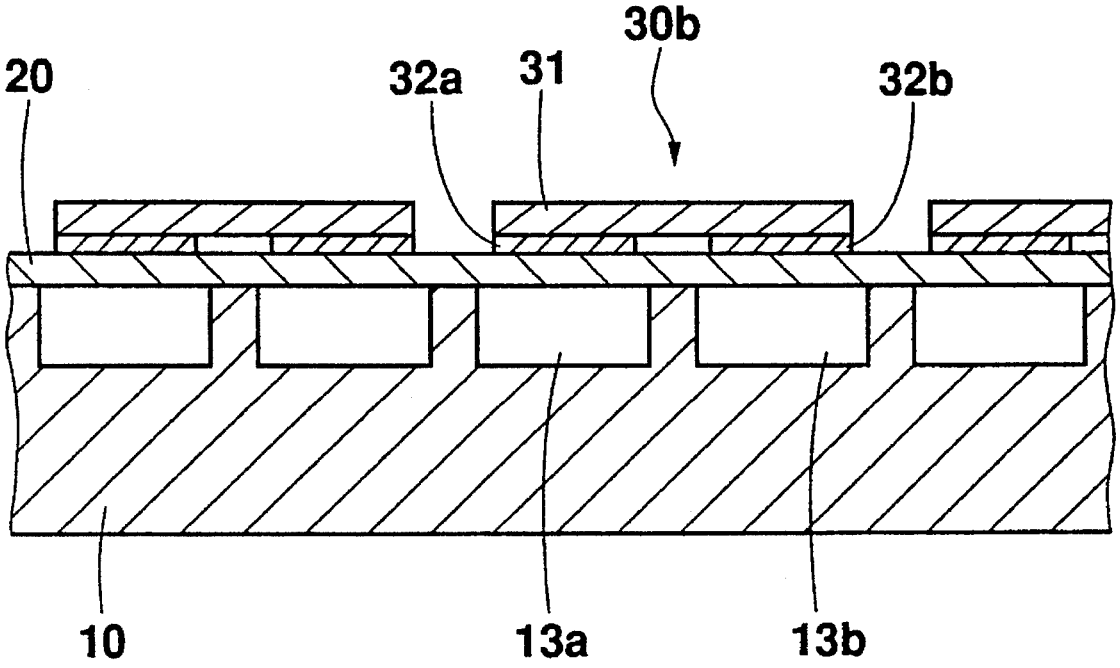
FIG. 8 is an enlarged sectional view of the main part of still another embodiment of a printing head according to the present invention.

FIG. 7 shows another embodiment of a printing head according to the present invention. In this embodiment, a diaphragm displacing means 30*a* is composed only of the piezoelectric element 31 and the electrodes 33*a*, 33*b* provided on the upper surface of the piezoelectric element 31. Although the number of electrodes are reduced in comparison with the embodiment shown in FIG. 6 which is provided the electrodes on both surfaces of the piezoelectric element 31, the operation is approximately the same. It is also possible to provide only the electrodes 32*a*, 32*b* on the under surface of the piezoelectric element 31 as in still another embodiment shown in FIG. 8.

Figure 9:
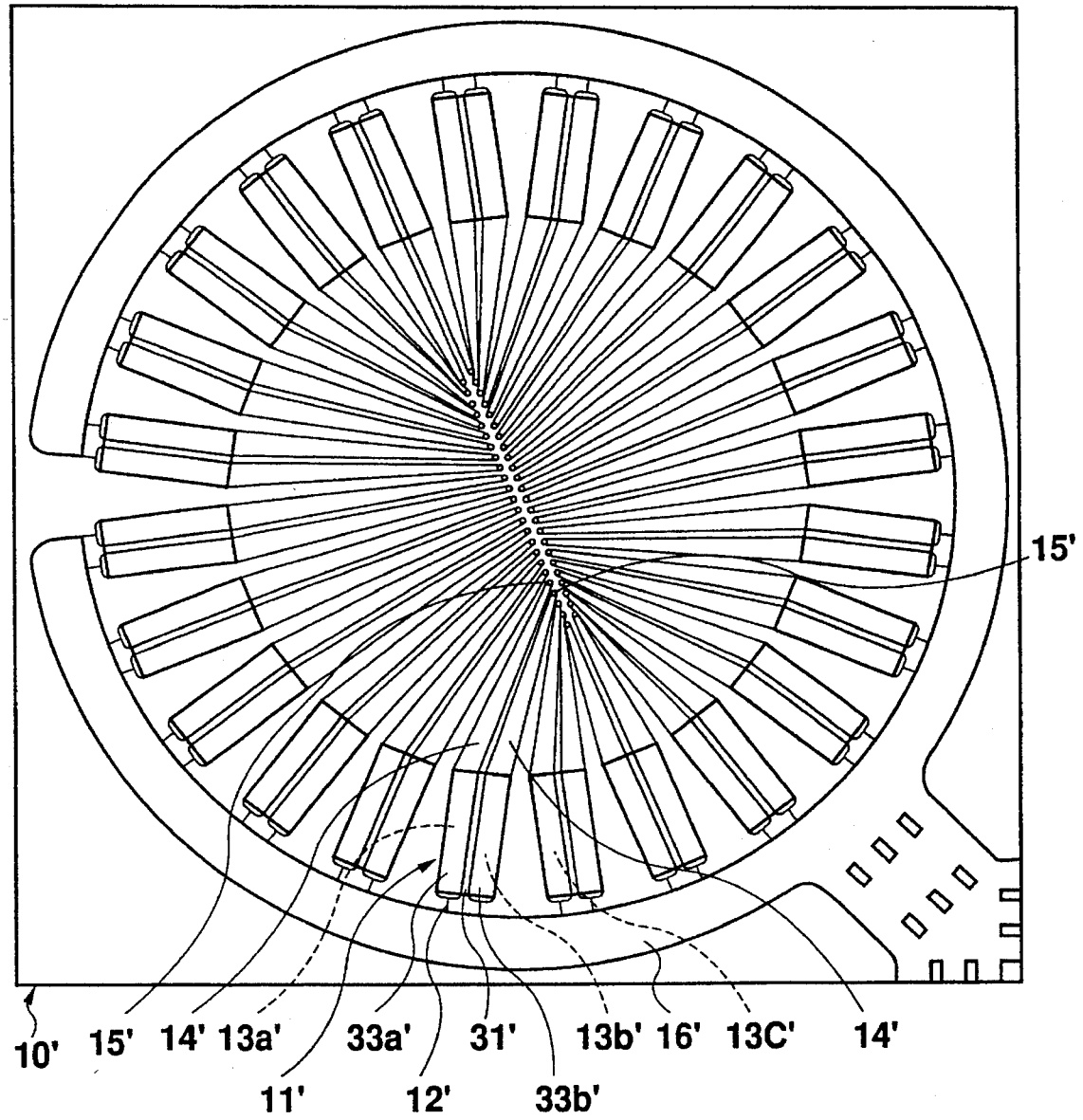
FIG. 9 is a plan view of a further embodiment of a printing head according to the present invention in which pressure chambers are arranged in a circle.
Figure 10:
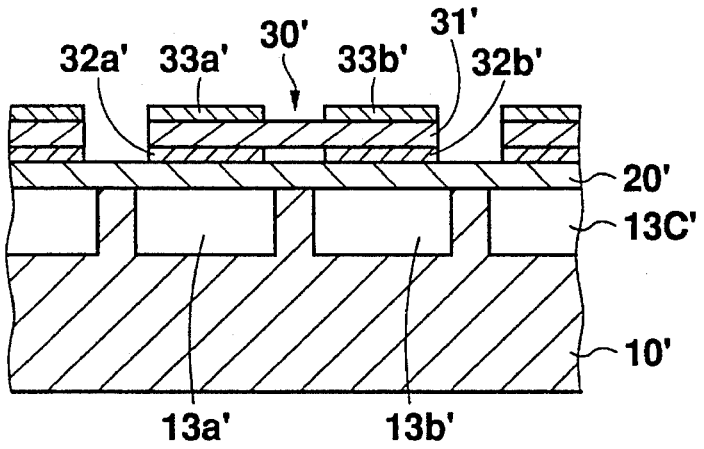
FIG. 10 is an enlarged sectional view of the main part of the printing head shown in FIG. 9.

In a further embodiment shown in FIGS. 9 and 10, a substrate 10' is provided with individual ink passages 11' composed of pressure chambers 13*a*', 13*b*', 13*c*', . . . which are arranged in a circle, leading portions 14' which extend obliquely from the pressure chambers 13*a*', 13*b*', 13*c*', . . . and nozzles 15'. A diaphragm 20' covering all the individual ink passages 11' is attached to the substrate 10' on the side on which the individual ink passages 11' are provided, and the individual ink passages 11' are sealed by the diaphragm 20'. As shown in FIGS. 9 and 10, a piezoelectric element 31' which is approximately the same in size as adjacent two pressure chambers 13*a*', 13*b*' is pasted to the corresponding portion of the diaphragm 20' through the lower electrodes 32*a*', 32*b*' on each couple of adjacent individual ink passages 11', and upper electrodes 33*a*', 33*b*' are pasted to the upper portion of the piezoelectric element 31'.

Figure 11:
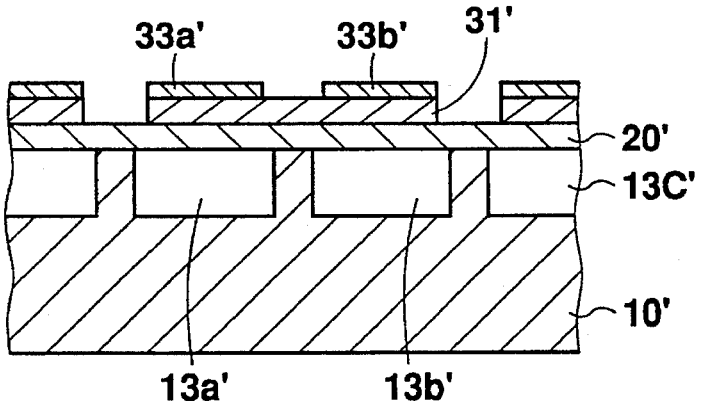
FIG. 11 is an enlarged sectional view of the main part of a still further embodiment of a printing head according to the present invention.
Figure 12:
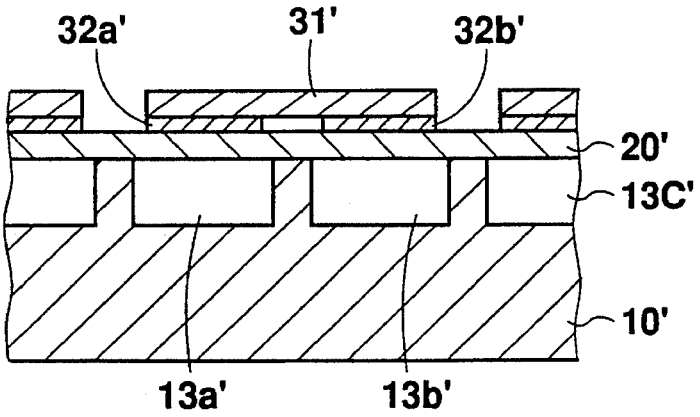
FIG. 12 is an enlarged sectional view of the main part of a still further embodiment of a printing head according to the present invention.

In this embodiment, a voltage is also applied to the upper electrodes 33*a*', 33*b*', and the lower electrodes 32*a*', 32*b*' so as to displace the piezoelectric element 31' and warp the diaphragm 20', thereby injecting the ink. The electrodes may be provided only on a single surface of the piezoelectric element 31', as shown in FIGS. 11 and 12, in the same way as in the embodiments shown in FIGS. 7 and 8.

Figure 13:
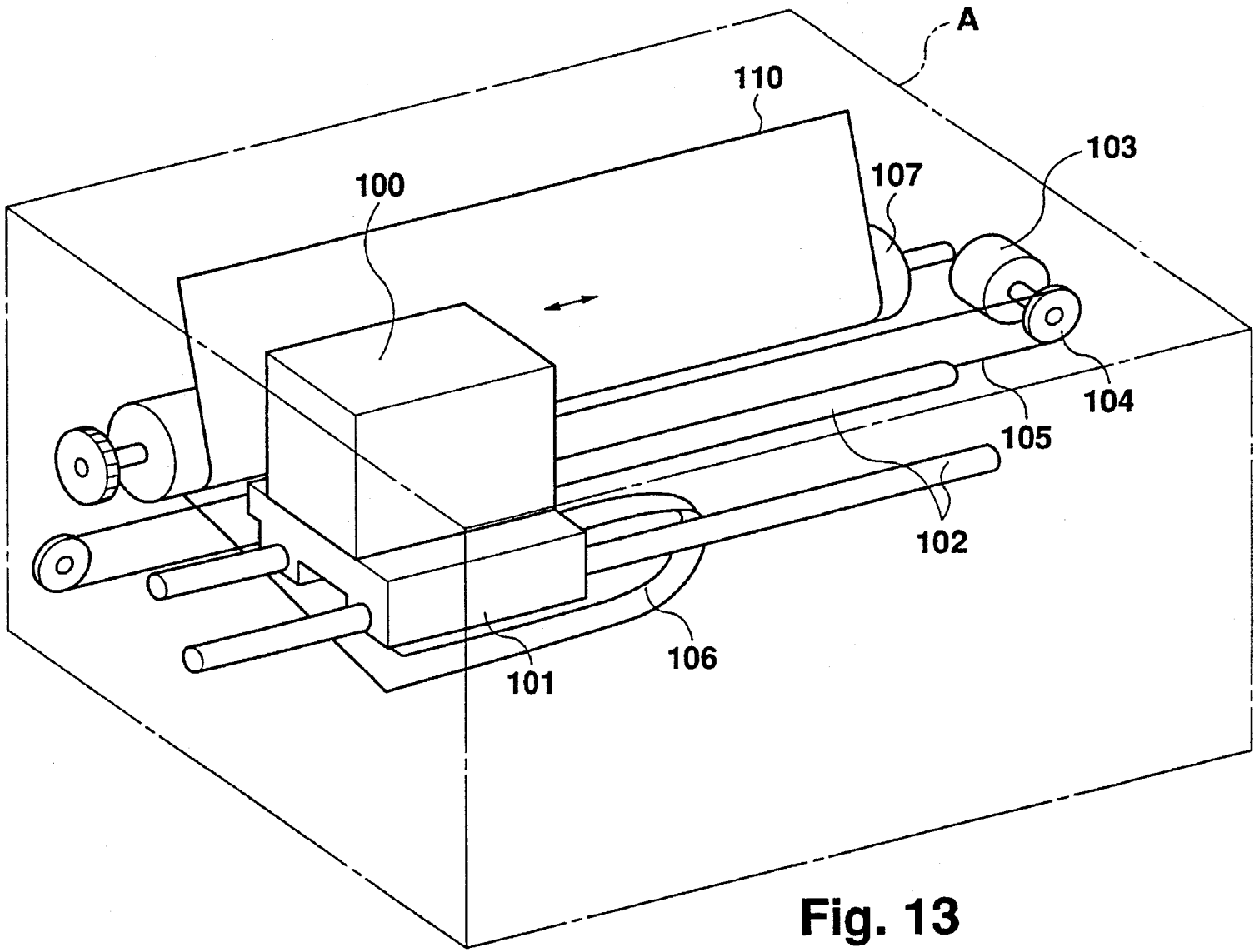
FIG. 13 is a perspective view of an electronic machine incorporating a printing head according to the present invention.

FIG. 13 shows an electronic machine incorporating a printing head according to the present invention. In a printer A, an ink jet printing head is disposed in a cartridge 100 on a carriage 101 which is slidable on two guides 102. A wire 105 is horizontally moved by the rotation of a pulley 104 which is driven by a motor 103. The carriage 101 also moves horizontally together with the movement of the wire 105. The ink injection of the ink jet printing head is controlled through a flexible cable 106. Printing is made on paper 110 which is wound around a platen 107 in such a manner as to be facing the printing surface of the cartridge 100.

The ink jet printing head of the present invention having the above-described structure produces the following advantages.

(1) Since a diaphragm displacing means is provided on each couple of adjacent individual ink passages, the number of necessary piezoelectric elements is reduced to half in comparison with the conventional printing head which has the same number of individual ink passages of the same size. As a result, the number of manufacturing steps including the production of piezoelectric elements and the process of pasting the piezoelectric elements to the diaphragm is reduced.

(2) Even if the number of individual ink passages is increased and the width of each individual ink passage and the space between each couple of individual ink passages are decreased in order to enhance the density of the printing head, it is still easy to handle each piezoelectric element because it is twice as large as the piezoelectric element in the conventional printing head.

(3) Since the non-electrode portion of each diaphragm displacing means is aligned with the partition wall between the pressure chambers, as shown in the embodiments, if a transparent diaphragm is used, it is possible to utilize the partition wall as the alignment mark or the recognition mark in attaching the diaphragm displacing means to the diaphragm, thereby simplifying the assembly.

(4) Due to the advantages (1) to (3), the productivity is enhanced and the cost is reduced.

What is claimed is:

1. An ink jet printing head comprising:

a substrate including a plurality of pressure chambers which are formed in an array on said substrate such that each of said chambers extends from one end of said substrate to another end thereof, portions of the substrate intermediate adjacent pressure chambers separating and defining said pressure chambers;

a nozzle corresponding to each of said pressure chambers;

a diaphragm disposed on a surface of said substrate to cover said plurality of pressure chambers and to cover the portions of the substrate intermediate adjacent pressure chambers;

a plurality of piezoelectric elements, the plurality of piezoelectric elements being less than the plurality of pressure chambers, each of said piezoelectric elements provided over a portion of said diaphragm corresponding to a plurality of adjacent pressure chambers, and over portions of the substrate intermediate said adjacent pressure chambers, said diaphragm being intermediate said piezoelectric elements and said substrate; and means for actuating said piezoelectric elements to selectively actuate said adjacent pressure chambers so that each of said plurality of said adjacent pressure chambers corresponding to a piezoelectric element is actuable independently of actuation of adjacent pressure chambers that are activated by the same piezoelectric element.

2. An ink jet printing head according to claim 1, wherein the actuating means includes electrodes provided on two surfaces of each of said plurality of piezoelectric elements at areas corresponding to each of said adjacent pressure chambers corresponding to the respective piezoelectric elements.

3. An ink jet printing head according to claim 1, wherein each of said piezoelectric elements extends over two adjacent pressure chambers, said element having a width similar to a combined width of two adjacent pressure chambers.

4. An ink jet printing head according to claim 1, wherein the actuating means includes two electrodes spaced apart and positioned on one side of each individual piezoelectric element, each of the two electrodes corresponding to a respective pressure chamber.

5. The ink jet printing head of claim 1, wherein there are n pressure chambers and n/2 piezoelectric elements, each of the piezoelectric elements corresponding to two adjacent chambers.

6. An ink jet printing head comprising:

a substrate including a plurality of nozzles and a plurality of pressure chambers arranged in a circle around said nozzles;

a diaphragm disposed on a surface of said substrate to cover said plurality of pressure chambers;

a first piezoelectric element provided over said diaphragm at a portion corresponding to a first plurality of adjacent pressure chambers, wherein the diaphragm is intermediate said substrate and said first piezoelectric element;

a second piezoelectric element provided over said diaphragm at a portion corresponding to a second plurality of adjacent pressure chambers; and means for actuating said first piezoelectric element and said second piezoelectric element to selectively actuate said first plurality of adjacent pressure chambers and said second plurality of adjacent pressure chambers so that a first chamber in each of said pluralities of adjacent pressure chambers is actuable independently of actuation of a second chamber of said plurality of said adjacent pressure chambers.

7. An ink jet printing head according to claim 6, wherein the actuating means includes electrodes provided on two surfaces of each of said piezoelectric elements at areas corresponding to each of the corresponding adjacent pressure chambers.

8. An ink jet printing head according to claim 6, wherein each of said first piezoelectric element and said second piezoelectric element extends over two adjacent combined pressure chambers, each of said piezoelectric elements having a width similar to a combined width of two adjacent pressure chambers.

9. An ink jet printing head according to claim 6, wherein the actuating means includes two electrodes spaced apart and positioned on one side of each of the first and second piezoelectric elements, each of the two electrodes corresponding to a respective pressure chamber.

10. The ink jet printing head of claim 6, wherein there are n pressure chambers and n/2 piezoelectric elements, each of the piezoelectric elements corresponding to two adjacent chambers.

11. An electronic machine comprising: an ink jet printing head having a substrate including a plurality of pressure chambers which are formed in an array on said substrate such that each of said chambers extends from one end of said substrate to another end thereof, portions of the substrate intermediate adjacent pressure chambers separating and defining said pressure chambers, a plurality of nozzles, one nozzle corresponding to each of said pressure chambers, a diaphragm disposed on a surface of said substrate to cover said plurality of pressure chambers and to cover the portions of the substrate intermediate adjacent pressure chambers, said plurality of pressure chambers arranged into groups of adjacent pressure chambers, a plurality of individual piezoelectric elements, the plurality of individual piezoelectric elements being less than said plurality of pressure chambers, disposed over said diaphragm for respective groups of adjacent pressure chambers and disposed over portions of the substrate intermediate adjacent pressure chambers in the respective group, said diaphragm being intermediate said piezoelectric elements and said substrate, and means for actuating said individual piezoelectric elements to selectively actuate said adjacent pressure chambers so that first pressure chambers of each group of said adjacent pressure chambers are actuable independently of actuation of second pressure chambers of each group of said adjacent pressure chambers; and a driver for driving the ink jet print head.

12. The machine of claim 11, wherein each of the plurality of individual piezoelectric elements extends over two respective adjacent pressure chambers, each of the plurality of individual piezoelectric elements having a width similar to a combined width of two adjacent pressure chambers.

13. The machine of claim 11, wherein the actuating means includes electrodes provided on two surfaces of each of the plurality of individual piezoelectric elements at areas corresponding to each of said respective adjacent pressure chambers.

14. The machine of claim 11, wherein the actuating means includes two electrodes spaced apart and positioned on one side of each of the individual piezoelectric elements, each of the two electrodes corresponding to a respective pressure chamber.

15. The ink jet printing head of claim 11, wherein there are n pressure chambers and n/2 individual piezoelectric elements, each of the individual piezoelectric elements corresponding to two adjacent chambers.

16. An electronic machine comprising:

an ink jet printing head having a substrate including a plurality of nozzles and a plurality of pressure chambers arranged in a circle around said nozzles, a diaphragm disposed on a surface of said substrate to cover said plurality of pressure chambers, said plurality of pressure chambers arranged into pairs of adjacent pressure chambers, a plurality of piezoelectric elements provided on said diaphragm, each of the piezoelectric elements corresponding to a respective pair of adjacent pressure chambers, wherein the diaphragm is intermediate said substrate and each of said piezoelectric elements, and means for actuating each of said piezoelectric elements to selectively actuate said respective pair of adjacent pressure chambers so that a first pressure chamber of each pair of adjacent pressure chambers is actuable independently of actuation of a second pressure chamber of each pair of said adjacent pressure chambers.

17. The machine of claim 16, wherein each piezoelectric element extends over two respective adjacent pressure chambers, said piezoelectric elements having a width similar to a combined width of two adjacent pressure chambers.

18. The machine of claim 16, wherein the actuating means includes electrodes provided on two surfaces of each individual piezoelectric element at areas corresponding to each of said respective adjacent pressure chambers.

19. The machine of claim 16, wherein the actuating means includes two electrodes spaced apart and positioned on one side of each of the piezoelectric elements, each of the two electrodes corresponding to a respective pressure chamber.

20. The ink jet printing head of claim 16, wherein there are n pressure chambers and n/2 piezoelectric elements, each of the piezoelectric elements corresponding to two adjacent chambers.

* * * * *